US005933088A

United States Patent [19]

Lipp

[11] Patent Number: 5,933,088

[45] Date of Patent: Aug. 3, 1999

[54] PAGER WITH MESSAGE SEQUENCING

[75] Inventor: Ronald Lee Lipp, Grand Prairie, Tex.

[73] Assignee: Uniden America Corporation, Fort Worth, Tex.

[21] Appl. No.: 08/400,190

[22] Filed: Mar. 6, 1995

Related U.S. Application Data

[63] Continuation of application No. 08/007,873, Jan. 22, 1993, abandoned.

[51] Int. Cl.[6] ..... G08B 5/22

[52] U.S. Cl. ..... 340/825.44; 455/38.4

[58] Field of Search ..... 455/39.1, 38.2, 455/38.4; 340/825.44

[56] References Cited

U.S. PATENT DOCUMENTS

| | | | |
|---|---|---|---|
| 3,849,979 | 11/1974 | Tanji . | |
| 3,937,004 | 2/1976 | Natori et al. . | |
| 4,197,526 | 4/1980 | Levine et al. . | |
| 4,202,038 | 5/1980 | Petersson | 341/23 |
| 4,249,165 | 2/1981 | Mori . | |
| 4,336,524 | 6/1982 | Levine . | |
| 4,367,467 | 1/1983 | Emile, Jr. . | |
| 4,385,295 | 5/1983 | Willard et al. . | |
| 4,412,217 | 10/1983 | Willard et al. . | |
| 4,438,433 | 3/1984 | Smoot et al. . | |
| 4,477,807 | 10/1984 | Nakajima et al. . | |
| 4,536,761 | 8/1985 | Tsunoda et al. | 340/825.44 |
| 4,558,396 | 12/1985 | Kawabata et al. . | |
| 4,644,350 | 2/1987 | Ishii . | |
| 4,654,631 | 3/1987 | Kurcbart et al. . | |
| 4,704,740 | 11/1987 | McKee et al. . | |
| 4,713,659 | 12/1987 | Oyagi et al. . | |
| 4,754,275 | 6/1988 | Abbaticchio et al. . | |
| 4,838,661 | 6/1989 | McKee et al. . | |
| 4,868,563 | 9/1989 | Stair et al. . | |
| 4,876,537 | 10/1989 | Oyamada . | |
| 5,285,493 | 2/1994 | Wagai et al. | 340/825.44 |
| 5,398,022 | 3/1995 | Lipp | 340/825.44 |

OTHER PUBLICATIONS

M. Goldenberg & E. Fernandez, "Automatic Backlighting Device", Motorola, Inc. Technical Developments, vol. 16, Aug. 1992, Cover Sheet, p. 167.

S. Leonard & J. Dascanio, "Remind Alert", Motorola, Inc. Technical Developments, vol. 15, May 1992, Cover Sheet, p. 1.

Instruction Manual for NEC Display Pager, Model R1D44C, 48 pages; 1986.

*Primary Examiner*—Edwin C. Holloway, III
*Assistant Examiner*—Edward Merz
*Attorney, Agent, or Firm*—Sidley & Austin

[57] ABSTRACT

The pager has flexible sequencing of messages to the display. The sequencing of messages on the display is done either manually by switch actuation, automatically by a timed delay sequencing method, or by a combination of both. The method of message sequencing and the illumination of the display is controlled solely by the pager user and may be controlled by a single switch.

27 Claims, 10 Drawing Sheets

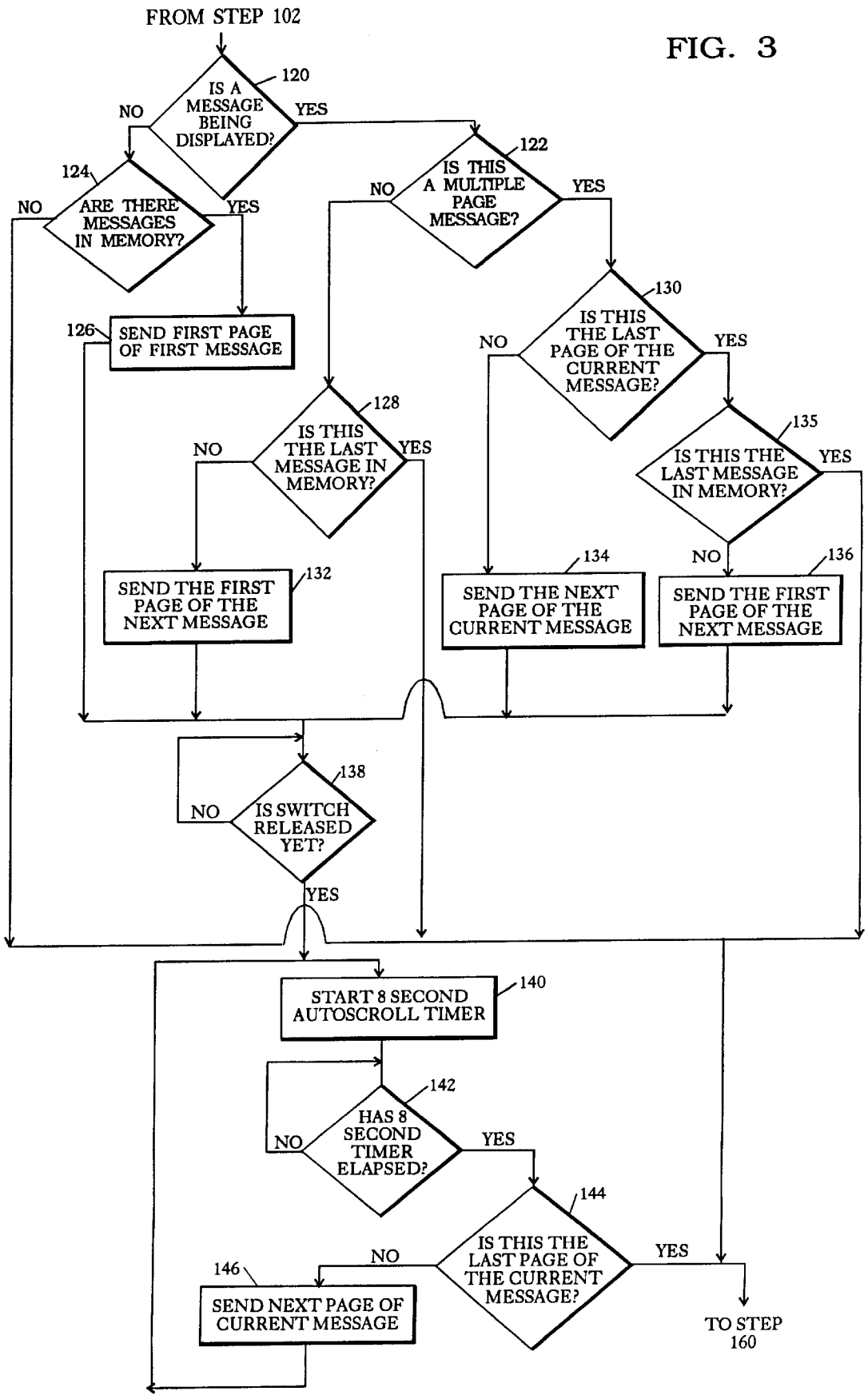
FROM STEP 102
FIG. 3
IS A MESSAGE BEING DISPLAYED?
120
NO
YES
ARE THERE MESSAGES IN MEMORY?
124
NO
YES
SEND FIRST PAGE OF FIRST MESSAGE
126
IS THIS A MULTIPLE PAGE MESSAGE?
122
NO
YES
IS THIS THE LAST PAGE OF THE CURRENT MESSAGE?
130
NO
YES
IS THIS THE LAST MESSAGE IN MEMORY?
128
NO
YES
IS THIS THE LAST MESSAGE IN MEMORY?
135
YES
NO
SEND THE FIRST PAGE OF THE NEXT MESSAGE
132
SEND THE NEXT PAGE OF THE CURRENT MESSAGE
134
SEND THE FIRST PAGE OF THE NEXT MESSAGE
136
IS SWITCH RELEASED YET?
138
NO
YES
START 8 SECOND AUTOSCROLL TIMER
140
HAS 8 SECOND TIMER ELAPSED?
142
NO
YES
IS THIS THE LAST PAGE OF THE CURRENT MESSAGE?
144
NO
YES
SEND NEXT PAGE OF CURRENT MESSAGE
146
TO STEP 160

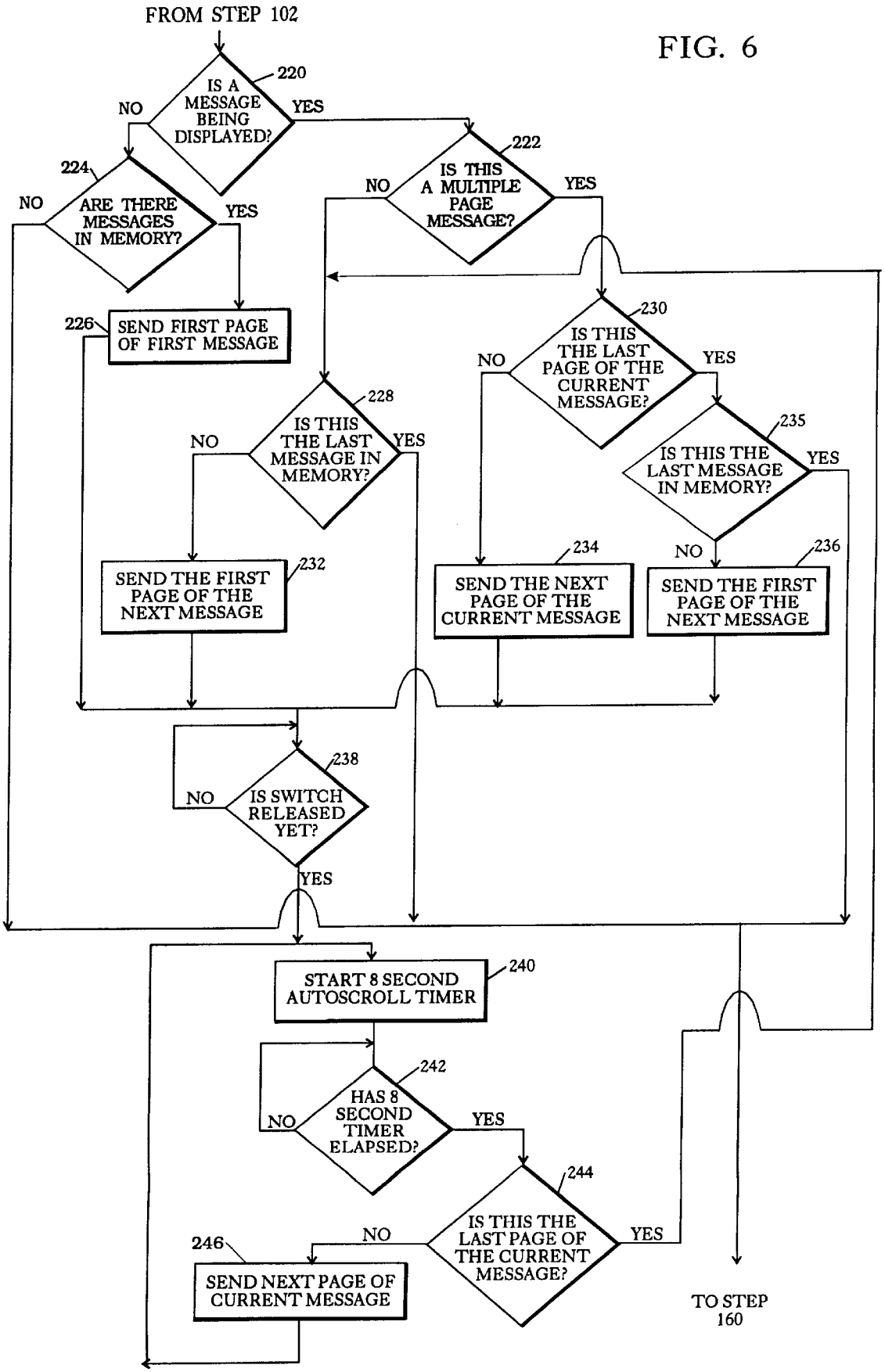
FROM STEP 102
FIG. 6
220
IS A MESSAGE BEING DISPLAYED?
NO
YES
224
ARE THERE MESSAGES IN MEMORY?
NO
YES
222
IS THIS A MULTIPLE PAGE MESSAGE?
NO
YES
226
SEND FIRST PAGE OF FIRST MESSAGE
230
IS THIS THE LAST PAGE OF THE CURRENT MESSAGE?
NO
YES
228
IS THIS THE LAST MESSAGE IN MEMORY?
NO
YES
235
IS THIS THE LAST MESSAGE IN MEMORY?
YES
NO
232
SEND THE FIRST PAGE OF THE NEXT MESSAGE
234
SEND THE NEXT PAGE OF THE CURRENT MESSAGE
236
SEND THE FIRST PAGE OF THE NEXT MESSAGE
238
IS SWITCH RELEASED YET?
NO
YES
240
START 8 SECOND AUTOSCROLL TIMER
242
HAS 8 SECOND TIMER ELAPSED?
NO
YES
244
IS THIS THE LAST PAGE OF THE CURRENT MESSAGE?
NO
YES
246
SEND NEXT PAGE OF CURRENT MESSAGE
TO STEP 160

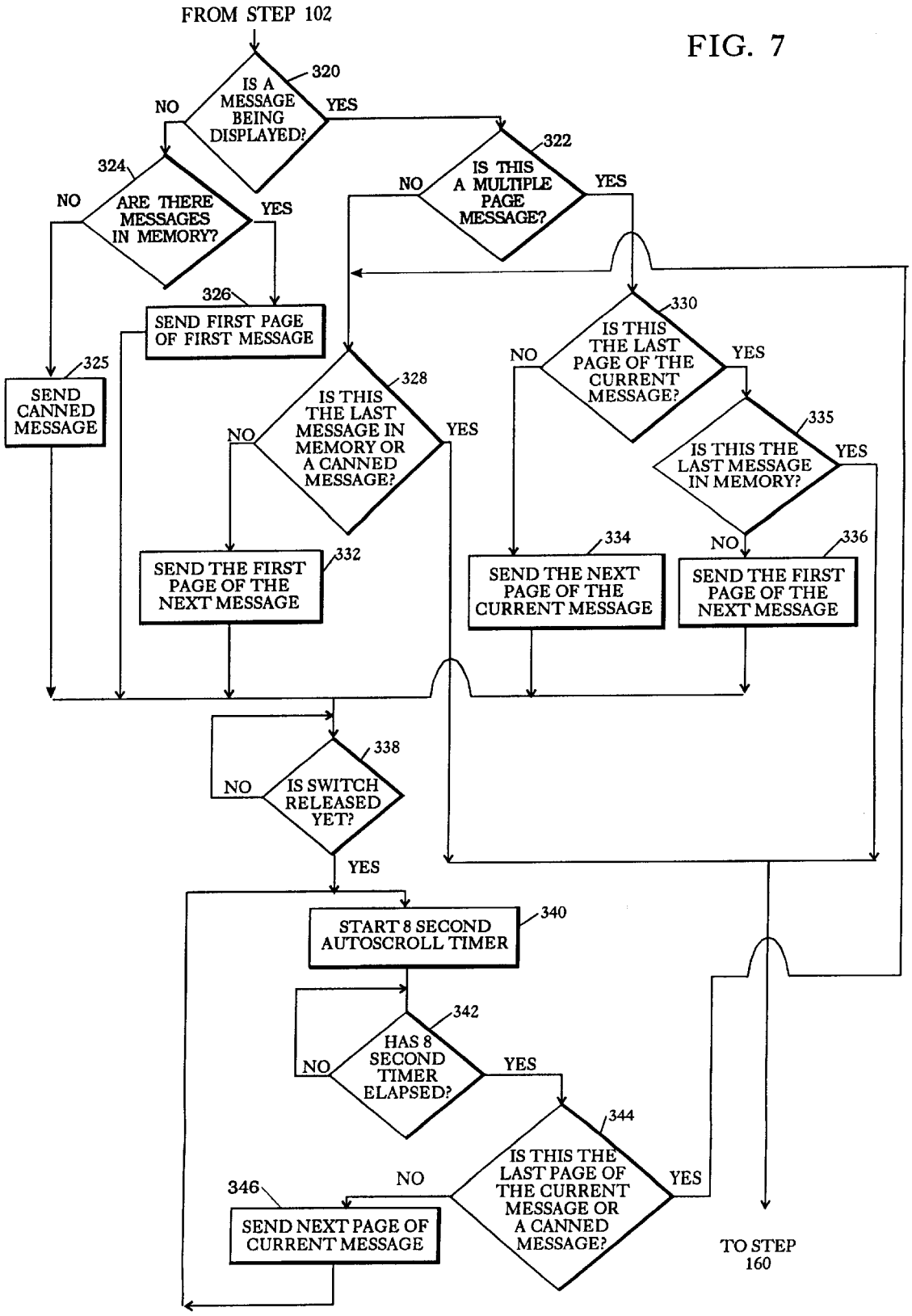
FROM STEP 102
FIG. 7
IS A MESSAGE BEING DISPLAYED?
320
NO
YES
ARE THERE MESSAGES IN MEMORY?
324
NO
YES
SEND FIRST PAGE OF FIRST MESSAGE
326
SEND CANNED MESSAGE
325
IS THIS A MULTIPLE PAGE MESSAGE?
322
NO
YES
IS THIS THE LAST MESSAGE IN MEMORY OR A CANNED MESSAGE?
328
NO
YES
SEND THE FIRST PAGE OF THE NEXT MESSAGE
332
IS THIS THE LAST PAGE OF THE CURRENT MESSAGE?
330
NO
YES
IS THIS THE LAST MESSAGE IN MEMORY?
335
YES
NO
SEND THE NEXT PAGE OF THE CURRENT MESSAGE
334
SEND THE FIRST PAGE OF THE NEXT MESSAGE
336
IS SWITCH RELEASED YET?
338
NO
YES
START 8 SECOND AUTOSCROLL TIMER
340
HAS 8 SECOND TIMER ELAPSED?
342
NO
YES
IS THIS THE LAST PAGE OF THE CURRENT MESSAGE OR A CANNED MESSAGE?
344
NO
YES
SEND NEXT PAGE OF CURRENT MESSAGE
346
TO STEP 160

PAGER WITH MESSAGE SEQUENCING

This is a continuation of U.S. patent application Ser. No. 08/007,873 filed Jan. 22, 1993 now abandoned.

TECHNICAL FIELD OF THE INVENTION

The present invention relates to pager message sequencing. More particularly, this invention relates to automatic and manual sequencing of multiple messages and multiple page messages on the pager display.

BACKGROUND OF THE INVENTION

Display paging receivers are widely used for information transfer. A goal of pager designers is to reduce the size and cost of each pager while working within the constraint that a pager must minimize its energy consumption due to limited battery power. Additionally, the goal of pager designers is to provide as much flexibility in the presentation of messages as possible.

To display received information, pagers typically utilize displays which are capable of presenting alphanumeric data and messages of various lengths. In an effort to effectively display information and meet pager design goals, a liquid crystal display (LCD) is generally used. The LCD display is utilized because it has substantial flexibility in the format and presentation of messages, it is extremely compact, and it consumes very little power.

Modern display pagers may possess the capabilities of displaying multiple page messages and multiple messages received by the pager. Currently known methods for scrolling multiple messages or multiple page messages to the pager display, however, are not as flexible and effective as needed. For example, U.S. Pat. No. 4,536,761 to Tsunoda describes one currently known method of scrolling messages on a pager display requiring a message switch actuation to display each message stored in memory. This method of displaying messages is known as manual scrolling of messages to the display.

More flexible message scrolling features are desirable. A primary need in the presentation of multiple messages and multiple page messages is the ability to choose between automatic and manual scrolling of pages of a message stored in the pager memory to the display. Other desirable features include: programmable and adjustable delays between screen displays; providing "canned" or other status messages in conjunction with automatic message scrolling; and, retaining a message on the screen for a desired time period.

SUMMARY OF THE INVENTION

In general, the present invention controls the sequencing of messages to the display in an automatic or manual manner. This invention provides for alternative methods of viewing multiple messages and multiple page messages on the pager display. The method of display is chosen by the pager user and is under the pager user's exclusive control.

Additionally, the pager may possess other message presentation features such as displaying a canned message. This canned message may appear on the pager display upon predetermined conditions such as when the pager has not received any messages. Other desirable features may include controlling the delay period between message scrolling or retaining a message on the display for an extended period of time as determined by the pager user.

The sequencing of messages may be combined with the illumination of the display by utilizing the message transfer switch to also control display illumination. Overall, a low-cost display pager with flexible message sequencing and display illumination features is provided herein by this incorporation of the message transfer switch with the illumination feature.

BRIEF DESCRIPTION OF THE DRAWINGS

The features of the present invention which are believed to be novel are set forth with particularity in the appended claims. The invention, together with further objects and advantages thereof, may be best understood by making reference to the following description taken in conjunction with the accompanying drawings, in the several figures of which like reference numerals identify identical elements, and wherein:

FIGS. 2, 3 and 4 are flow charts illustrating the operation of the preferred embodiment of the present invention, FIGS. 5, 6, 7, 8 and 9 are flow charts illustrating the operation of alternative embodiments of the present invention.

DETAILED DESCRIPTION OF THE PREFERRED EMBODIMENT

Figure 1:
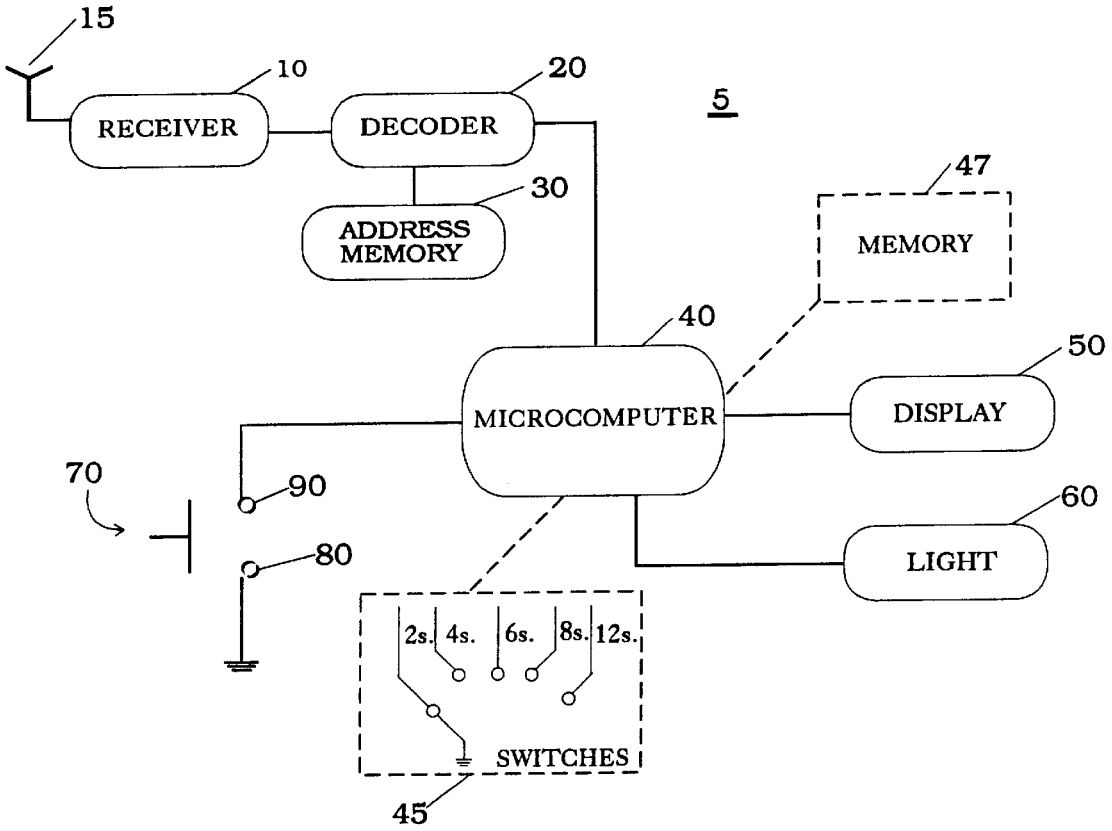
FIG. 1 is an electrical block diagram of the preferred embodiment of the present invention.

Reference is directed to FIG. 1 which shows a block diagram of a pager apparatus 5. As shown in FIG. 1, the pager 5 includes an antenna 15 coupled to a receiver 10. The antenna 15 and receiver 10 enable the pager to receive transmitted coded message signals in a conventional manner. The coded message signals received by the pager 5 include selective address and message information well known in the art.

The receiver 10 transfers the received coded message signals to a decoder 20. After the receiver 10 provides the received coded message signal to the decoder 20, a selective address portion of the coded message is compared to an address held in an address memory 30. If the selective address portion of the message matches the address held in memory 30, the pager 5 determines that it has been addressed by the transmitted coded message signal. The decoding and address detection sequence may be controlled by decoder 20 as a discrete circuit or by a microcomputer 40 performing the decode operation. Likewise, the address memory may be a discrete component (as shown) or may be included within some portion of the internal memory of microcomputer 40. Microcomputer 40 can be, for example, a model M37410M4, manufactured by Mitsubishi.

If the pager 5 has been addressed, the coded message signal is transferred to the microcomputer 40. The microcomputer 40 processes the coded message signal in order to ascertain the message transferred to the pager 5. A single message received by the pager comprises one or more pages of information capable of being displayed on the pager display in one displayed segment or in multiple display segments, respectively. The receiving, decoding and processing of the coded message signals is well known in the art.

After processing the coded message signal, the message transferred to the pager 5 may be stored in memory. This memory may reside in the microcomputer 40 or may be a discrete memory component 47 coupled to the microcomputer 40. It is useful to store all messages in memory for retrieval and display at a later time.

The messages stored in memory may be retrieved and transferred to a display 50 in response to operation of a switch 70. Display 50, preferably a liquid crystal display, is driven by microcomputer 40. Switch 70 is normally open making no contact with nodes 80 and 90. Switch 70 is actuated by depressing a button element of switch 70 into connection between nodes 80 and 90. Upon actuation of switch 70 into a closed position, nodes 80 and 90 are placed in electrical connection with each other thereby providing a ground signal to an input terminal of microcomputer 40. This signal activates various retrieval sequencing operations, described below, in microcomputer 40. Switch 70 need not be actuated for an extended period of time in order to initiate message retrieval and display.

The microcomputer 40 also controls the illumination of a light 60 to aid the backlighting of display 50. Light 60 is preferably an incandescent low voltage lamp element capable of being activated by an output from microcomputer 40. The illumination of light 60 is initiated by microcomputer 40 in response to closure of switch 70 for a period of time greater than the time period needed for activating other functions of the pager 5. That is, microcomputer 40 illuminates light 60 only if the actuation of switch 70 extends for more than a predetermined time period. If switch 70 is actuated for less than the predetermined amount of time, the microcomputer 40 will not illuminate light 60.

Thus, switch 70 is actuated for less than a predetermined time period to control normal message retrieval from memory and sequencing to the display 50. When the pager user encounters low ambient light conditions, the light 60 is illuminated if the switch 70 is actuated for longer than a predetermined time period. Thus, the activation of light 60 is controlled exclusively by the pager user because this function is dependent on the time duration of switch actuation. While other predetermined time periods may be used, a predetermined time period found most effective in this application is 1.5 seconds.

The switch 70 which is utilized to illuminate the display 50 may be a switch used to control any pager function and need not necessarily control the message retrieval function. The only prerequisite for the selection of this illumination control switch is that the other control function operated by the switch must be activated in response to a switch actuation of less than the selected predetermined time period.

The method of backlighting the display 50 in the present invention eliminates the need for photosensors or extra switches on the pager. The elimination of these additional elements reduces the cost of the pager. Additionally, the elimination of these extra elements conserves the pager's circuit board space needed to support these additional elements. This additional board space may be eliminated to reduce the size of the pager or may be devoted to support other functions for the pager.

Pager 5 may optionally include switches 45 which can be used to set time periods for operation of the pager 5. These switches can set the delay period for message scrolling. Additionally, similar switches may be disposed on the pager to control the predetermined time delay period for light source 60 illumination. The time period for each switch in the illumination operation may be 1 sec., 1.5 sec., 2.0 sec., 2.5 sec., and 3.0 sec., instead of the time designations marked in FIG. 1.

Figure 2:
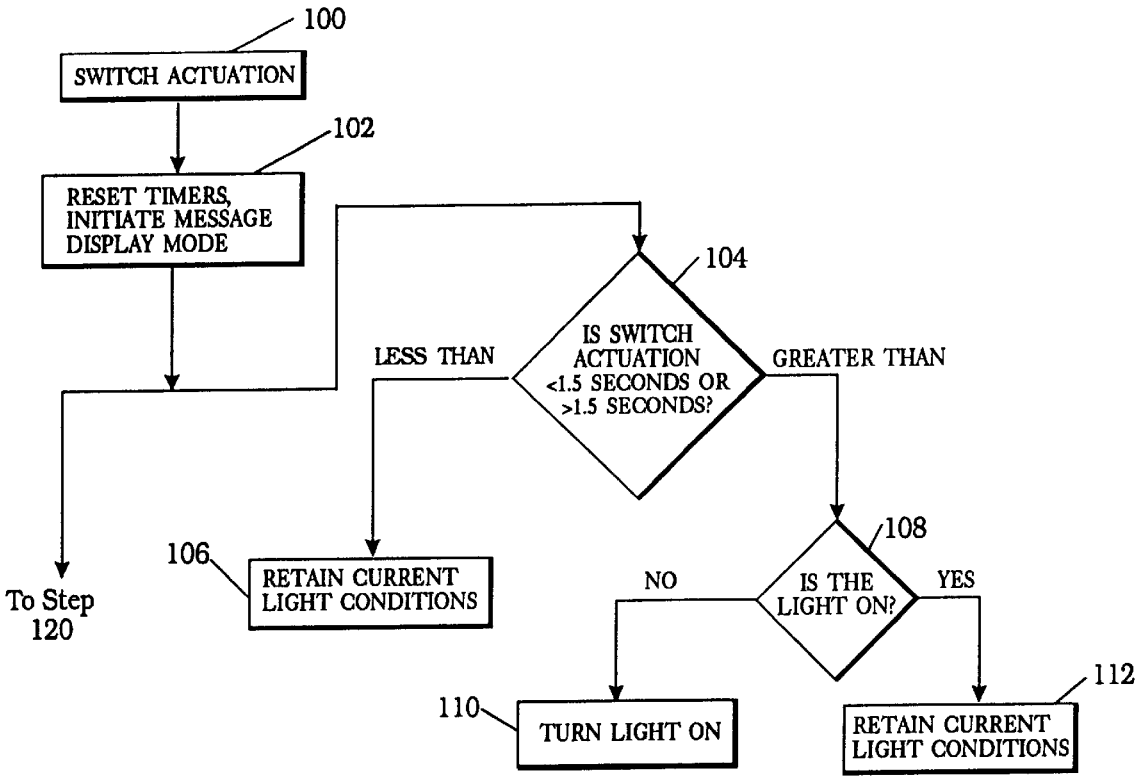

Referring to FIG. 2, the display illumination operation of pager 5, in accordance with the preferred embodiment, is demonstrated. The operation begins when switch 70 is actuated in step 100. This switch actuation may be an initial actuation or a subsequent actuation during the message scrolling and illumination sequence. Control of the message scrolling and illumination operation is always transferred to step 100 upon each and every switch actuation. That is, the control program will fall out of any step in the set program and transfer control to step 100 whenever a subsequent switch actuation occurs for reinitiation of the program sequence.

After switch actuation in step 100, software timers controlled by microcomputer 40 are reset and the message display mode is initiated in step 102. After step 102, control is transferred to steps 120 and 104 simultaneously.

In step 104, if switch actuation is less than 1.5 seconds, control is transferred to step 106. In step 106, the light conditions are retained from the previous light condition state. That is, the light 60 will remain activated if it was previously activated or will remain deactivated if it was previously deactivated.

If switch actuation continues for a time period greater than 1.5 seconds, control is transferred from step 104 to step 108. In step 108, the status of the light 60 is determined. If the light 60 is already illuminated, control is transferred from step 108 to step 112 where light conditions are retained. If, however, the light 60 is not already activated as determined in step 108, control is transferred to step 110 where light 60 is activated.

Although this embodiment utilizes 1.5 seconds as a predetermined time period, the invention is not specifically restricted to this time period. The predetermined time of 1.5 seconds is considered a reasonable amount of time for a pager user to actuate switch 70 in order to activate a secondary function aside from the primary function initiated by momentary actuation of switch 70. Other predetermined times may be used for display illumination.

Further, the microcomputer 40 may be configured to allow a pager user to set the predetermined time period for activation of the secondary function and other predetermined time periods. The setting of predetermined time periods may be accomplished by initial programming of the microcomputer 40, by setting physical switches 45 on the pager 5, or by selecting various choices on a pager user interaction program (see FIG. 10). These predetermined time periods may be selected to best suit the needs of the individual pager user.

Referring to FIG. 3, when control is transferred from step 102 to step 120, the control program determines if a message is being displayed. If a message is not being displayed, control is transferred from step 120 to step 124. In step 124, the pager control program determines whether there are any messages in memory. If there are no messages in memory, control is transferred to step 160. If there are messages stored in memory, as determined in step 124, control of the message display operation is transferred to step 126. In step 126, the first page of the first message in memory is sent to the display 50.

Following step 126, control is transferred to step 138. In step 138, the status of the switch 70 is determined. If the switch 70 is actuated (not released), control will not be transferred from step 138. The message being displayed will be retained on the display 50 until the pager user releases the switch 70. This feature allows the pager user to suspend the message display operation thereby holding a message on the display 50 for an indefinite period of time. This feature allows the pager user time to write down or otherwise record messages or numbers on the pager display. Control is transferred to step 140 if the switch 70 has been released before control is transferred to step 138 or if the switch 70 is released while in step 138.

An autoscroll sequence is initiated in step 140. In step 140, the pager 5 initiates a software timer controlled by microcomputer 40. After step 140, control is transferred to step 142 which determines when a predetermined time interval has elapsed. In the preferred embodiment, the time interval for this scrolling sequence is eight (8) seconds.

This predetermined time interval, however, may be altered or changed to suit the needs of the pager user. For instance, some users may chose a twelve (12) second time period while others may chose a six (6) second time period. This time period may be adjusted, as described above, by setting physical switches 45 on the pager 5 or by selecting various choices on a pager user interaction program (see FIG. 10).

After the eight second time period has elapsed, control is transferred to step 144. In step 144, the control program determines if the current page being displayed is the last page of the current message. If the last page of the current message is being displayed, control is transferred to step 160. If this page is not the last page of the current message, control is transferred from step 144 to step 146. In step 146, the next page of the current message is sent to the display 50 and control is transferred to step 140 for reinitiation of the autoscroll sequence. In this manner, the pages of a multiple page message will be scrolled automatically until all pages of the message have been scrolled or a subsequent switch actuation occurs. If a subsequent switch actuation occurs during the autoscroll sequence, control is transferred back to step 100 where the message transfer and illumination steps are reinitiated.

Referring back to step 120, if there is a message being displayed on the display 50, control is transferred to step 122. In step 122, the pager control program determines whether the message being displayed is a multiple page message. If the message being displayed is not a multiple page message, control is transferred to step 128. In step 128, the pager determines whether the message being displayed is the last message held in memory. If the message being displayed is the last message held in memory, control is transferred from step 128 to step 160.

If the message being displayed is not the last message in memory to be transferred to the display 50, control is transferred from step 128 to step 132. In step 132, the first page of the next message in memory is transferred to the display. After the first page of the next message in memory has been transferred to the display 50 in step 132, control is transferred to step 138 for the switch release determination and subsequently to step 140 where the autoscroll sequence is initiated.

Referring back to step 122, if a multiple page message is being displayed, control is transferred to step 130. Step 130 determines whether the current page of the message being displayed is the last page of that message in memory. If the current page of the message being displayed is the last page of this message, control is transferred to step 135. In step 135, the control program determines if the message being displayed is the last message stored in memory to be transferred to the display 50. If so, control is transferred to step 160.

If the message being displayed is not the last message to be retrieved from memory, control is transferred from step 135 to step 136. In step 136, the first page of the next message in memory is transferred to the display 50. After step 136, control is transferred to step 138 for the switch release determination and then to step 140 for initiation of the autoscroll function.

Referring back to step 130, if the current page of the message being displayed is not the last page of the this message, control is transferred to step 134. In step 134, the next page of the message being displayed is transferred to the display 50. After the operation of step 134, control is transferred to step 138 for the switch release determination and then to step 140 for operation of the autoscroll feature.

The pager user can also manually scroll each page of a multiple page message or each message stored in memory by repeatedly actuating the switch 70 to transfer control to step 100. That is, if the message display routine is already initiated, a subsequent switch actuation will always transfer control back to step 100. If multiple messages or multiple pages of messages are stored in memory upon this subsequent switch actuation, control is transferred from step 100 to step 102 and through steps 120 and 122. By transferring control through steps 120 and 122, a switch actuation after a message is being displayed will accomplish one of the following: 1) scroll the next page of the current message to the display; 2) scroll the next message in memory to the display (last page of current message must already be displayed); or 3) exit the scrolling process (last page of last message must already be displayed). Thus, if a message is being displayed when a subsequent switch 70 actuation occurs (not the last page of the last message), the next page of the displayed message or the first page of the next message will be manually scrolled and thereby shown on the display 50.

Thus, the pager user can choose either automatic or manual scrolling of multiple page messages by choosing the number of switch actuations during message retrieval operation. As shown in FIG. 2, if a multiple page message is retrieved from memory, each page of the multiple page message may be scrolled automatically utilizing the autoscroll feature beginning at step 140. No subsequent switch actuations are necessary to scroll each page of a multiple page message because of the automatic time lapse scrolling process. Alternatively, subsequent switch actuations manually scroll the next pages of a message.

A subsequent switch actuation when the last page of the current multiple page message is displayed will also initiate the display of the next message in memory to display 50. A subsequent switch actuation is necessary in the embodiment of FIG. 2 in order to scroll the next message stored in memory to the display 50. Thus, this embodiment of the invention allows for automatic and manual scrolling of message pages to the display, the suspension of the scrolling process through the use of an extended switch actuation in step 138, and the manual scrolling of messages stored in memory to display 50 through subsequent switch actuations.

Figure 4:
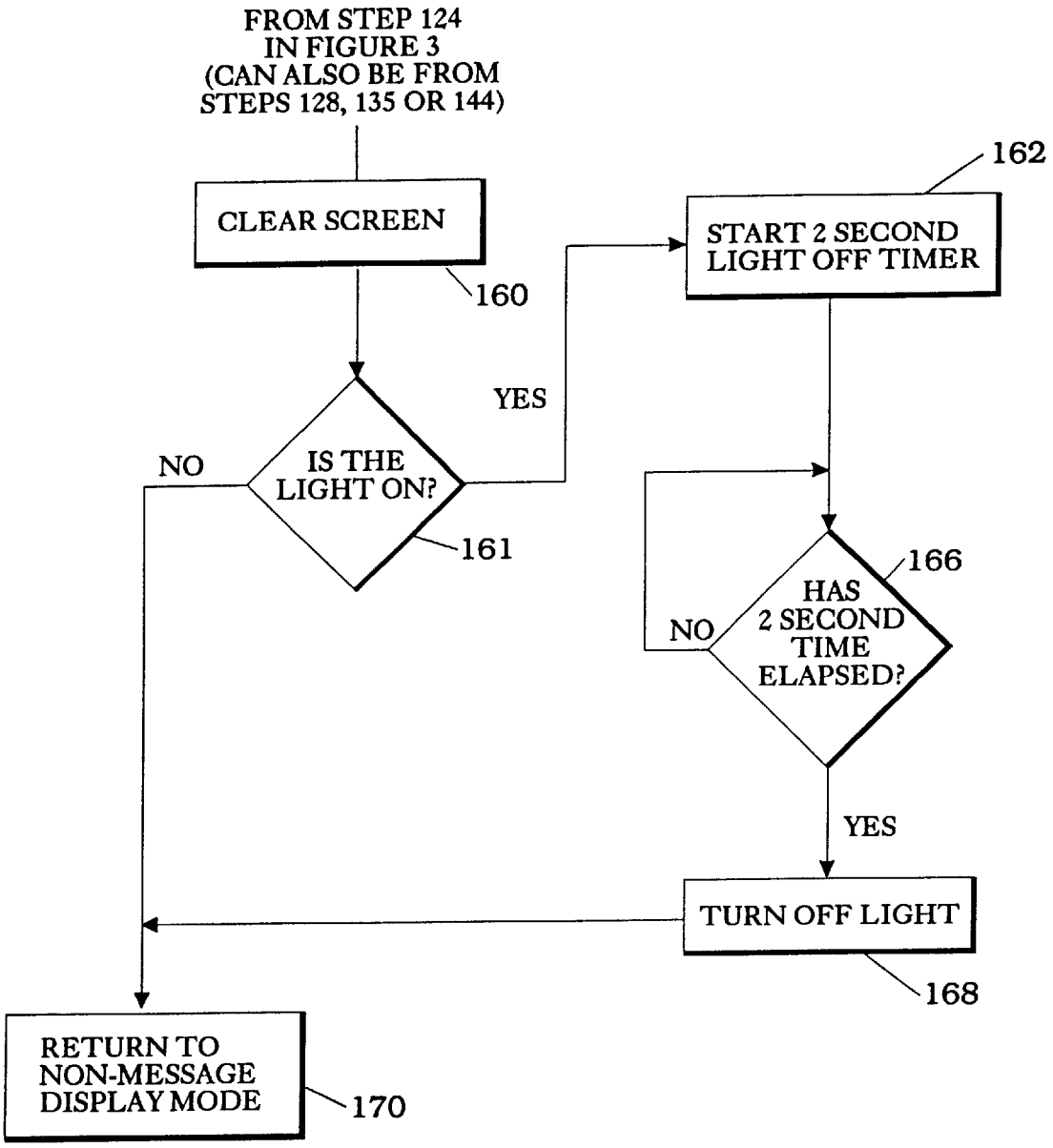

In FIG. 4, when no messages are stored in memory, operation is transferred from step 124 of FIG. 3 to step 160. Control may also be transferred to step 160 after operation of step 128, step 135 (when last message in memory is displayed) or step 144 (when last page of current message is displayed). Step 160 clears the screen of all data or messages. After step 160, control is transferred to step 161. Step 161 determines whether the light 60 is activated. If light 60 has not been activated, control is transferred to step 170 where the non-message display mode is initiated. The non-message display mode includes displaying a standby indicator message relating some type of status indicator message on the display, such as messages received, messages stored, messages protected, or unread messages.

If light 60 has been activated before step 161, control is transferred from step 161 to step 162 where a two second light off timer is initiated. Following step 162, control is transferred to step 166 where the pager determines when the two second time period has elapsed. After the two second timer has elapsed in step 166, control is transferred to step 168 where the light 60 is deactivated. After deactivation of light 60 in step 168, control is transferred to step 170 where the non-message display mode is initiated.

In this manner, after control is transferred to step 160, the light will be deactivated automatically after the two second time period elapses in step 166. This two second interval will allow the pager user to recognize the clear screen on the display. The light deactivation will occur unless a subsequent switch actuation occurs within this two second interval. If switch 70 is actuated within this two second interval, the light illumination display conditions will be retained.

This retention of illumination condition can be shown by referring back to FIG. 2. When the switch 70 is actuated during this two second interval in FIG. 4, control is transferred through steps 100, 102 and 104 in FIG. 2. If the subsequent switch actuation occurs for less than 1.5 seconds, control is transferred to step 106 where the pager will not change light conditions. If this subsequent switch actuation continues for longer than 1.5 seconds, control is transferred through step 108 to step 112 where the light conditions are retained from the previous condition. Thus, any switch actuation for any length of time during the two-second interval of step 166 in FIG. 4 will keep the lights activated. Otherwise, the lights will be deactivated after control is transferred from step 166 to step 168.

Figure 5:
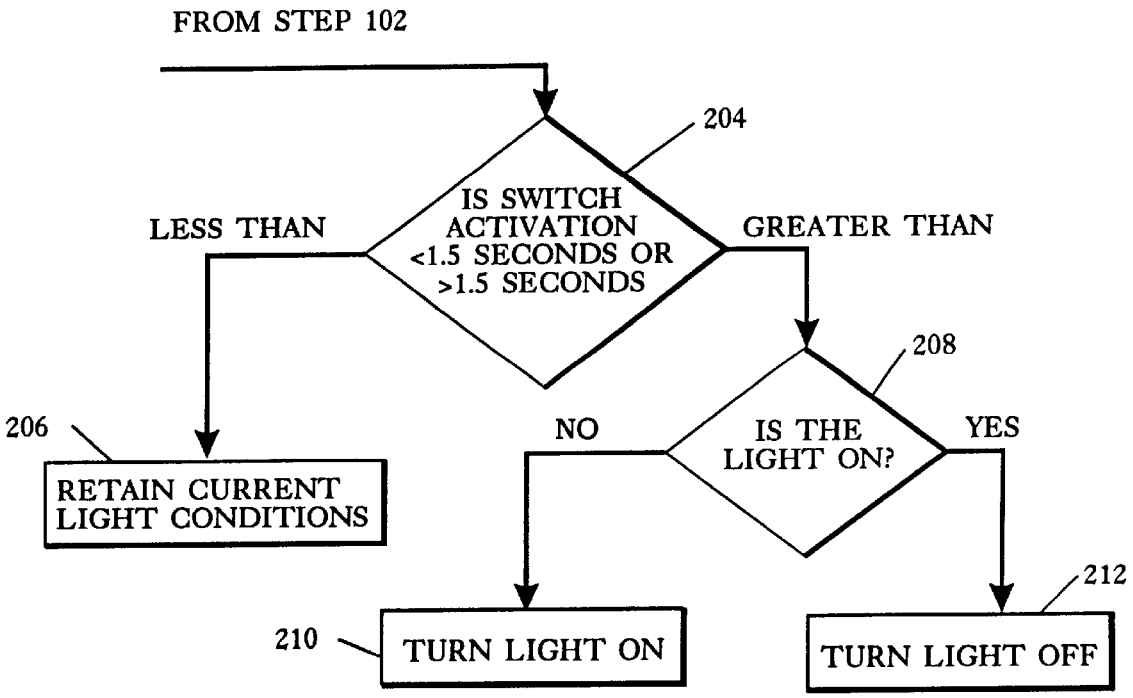

An alternative embodiment to that shown in FIG. 2 is illustrated in FIG. 5. The operation described in FIG. 5 allows for manual deactivation of the light 60 in conjunction with the automatic light deactivation of FIG. 4. During the message scrolling process, if the switch 70 is actuated, control is transferred from step 100 to step 102 and then to steps 204 and 120 simultaneously. In step 120 (not shown in FIG. 5), the scrolling process is controlled as previously described (refer to FIG. 3 for the operation of step 120 and subsequent steps). After control is transferred from step 102 to step 204, the length of time for the switch 70 actuation is determined. If switch actuation is less than 1.5 seconds, control is transferred to step 206 where light conditions are retained from the previous light conditions. If the switch 70 actuation time is determined to be greater than 1.5 seconds in step 204, control is transferred to step 208 where the condition of the light is determined. If the light is not activated, control is transferred from step 208 to step 210 where the light is turned on. If the light 60 is already activated in step 208, control is transferred to step 212 where the light 60 is turned off.

In this manner, both activation and deactivation of light 60 are controlled by the length of time that switch 70 is closed. Light activation is controlled by an initial extended time switch actuation while light deactivation is controlled by a subsequent extended time switch actuation.

This embodiment is useful when the light environment changes from low to high ambient light intensity. The illumination of the display is no longer necessary in such a situation. In this situation, and with the embodiment shown in FIG. 2, the pager user would have to terminate the message transfer sequence in order to deactivate the light. Otherwise, the light would remain activated during the entire message display sequence when it is no longer needed, thereby placing an unnecessary drain on battery power. In the embodiment shown in FIG. 5, the pager user can manually deactivate the light by actuating the switch 70 for an extended time instead of terminating the message display sequence or wasting battery power. Thus, a subsequent switch actuation for more than a predetermined time period allows the pager user to deactivate the light without interrupting the message sequencing operation. Additionally, the pager user can conserve battery power by not using the illumination circuit when illumination is no longer necessary.

In FIG. 6, an alternative embodiment to the multiple page scrolling process in FIG. 3 is disclosed. The embodiment shown in FIG. 6 provides autoscrolling of multiple page messages as well as autoscrolling for multiple messages stored in memory. No subsequent switch actuations are necessary in this embodiment to display the next message stored in memory (as in the embodiment disclosed in FIG. 3). Upon each switch actuation, control is transferred from step 100 to step 102 and then to step 220 where the control program determines if a message is being displayed. If no messages are being displayed, control is transferred to step 224 to determine if there are messages stored in memory. If no messages are stored in memory, control is transferred to step 160 (FIG. 4) for the clear message display.

Referring back to step 224, if messages are stored in memory, control is transferred from step 224 to step 226 where the first page of the first message in memory is sent to the display 50. After step 226, control is transferred to step 238. Step 238 is identical to the step 138 switch release determination (see FIG. 3).

After step 238, control is transferred to step 240. Step 240 initiates a multiple page autoscroll sequence in addition to initiation of a multiple message autoscroll sequence. After control is transferred to step 240, an eight second timer is started. Control is then transferred to step 242 to determine when the eight second time period has elapsed. If an eight second time period elapses without a subsequent switch actuation, control is transferred from step 242 to step 244 to determine whether the last page of the current message is being displayed. As noted above, if a subsequent switch actuation occurs at any point during the program sequence (including the autoscroll sequence), control is transferred to step 100 where the message transfer and illumination features are reinitiated.

If the current page of the message being displayed is not the last page of this message, control is transferred to step 246 where the next page of that message is transferred to the display 50. After this step, control is transferred to step 240 where the eight second timer is reinitiated. In this manner, all the pages of a multiple page message are scrolled automatically on a timed basis until the last page is displayed or a subsequent switch actuation occurs.

In step 244, if the current page of the message being displayed is the last page of the current message, control is transferred from step 244 to step 228. In step 228, it is determined whether the message being displayed is the last message held in memory. If the message being displayed is the last message held in memory, control is transferred from step 228 to step 160 (FIG. 4) for initiation of the clear message display.

If the message being displayed is not the last message held in memory, control is transferred from step 228 to step 232 where the first page of the next message held in memory is transferred to the display 50. After the first page of the next message is transferred to the display 50 by step 232, control is transferred to step 238 for the switch release determination and then to step 240 for the autoscroll operation.

In this manner, multiple page messages can be automatically scrolled by the transfer of control from step 244 to step 240 and multiple messages can be automatically scrolled by the transfer of control from step 244 to step 228. This automatic scrolling sequence requires only a single switch actuation to initiate the sequencing process of all pages of all messages. Thus, after a single switch actuation, the timed multiple page autoscroll feature will automatically scroll each page of a multiple page message on a time sequence basis and the multiple message autoscroll feature will automatically scroll each message in memory on a time sequence basis. All pages of all messages will be viewed with this method unless a subsequent switch actuation occurs.

If a subsequent switch actuation occurs during any step of the message sequence process, the control program will transfer control to step 100 and reinitiate the message sequencing process beginning with the next page of the message being displayed, the next message if the last page of the current message is being displayed, or ending the message sequence if the last page of the last message is being displayed.

If such a subsequent switch actuation occurs during this autoscroll sequence, control is transferred from step 100 to step 102 and then to step 220, where the control program determines whether there is a current message being displayed. If the control transfer to step 220 occurs during a message display due to a subsequent switch actuation, control is transferred from step 220 to step 222. In step 222, the control program determines whether the current message being displayed is a multiple page message. If the current message being displayed is not a multiple page message, control is transferred from step 222 to step 228. The operation of step 228 and subsequent steps is described above.

Referring back to step 222, if the current message being displayed is a multiple page message, control is transferred from step 222 to step 230. In step 230, the control program determines whether the current message being displayed is the last page of this current message. If the current page being displayed is the last page of this multiple page message, control is transferred from step 230 to step 235 where the control program determines if the current message is the last message held in memory. If so, control is transferred to step 160 for the clear message display. In step 235, if the displayed message is not the last message held in memory, control is transferred to step 236 where the first page of the next message in memory is transferred to the display. After step 236, control is transferred to step 238 for the switch release determination and then to step 240 for the autoscroll sequence initiation.

Referring to step 230, if the current page of the message being displayed is not the last page of this message, control is transferred to step 234. In step 234, the next page of the current multiple page message is transferred to the display 50. After operation of step 234, control is transferred to step 238 for the released switch determination and then to step 240 for the timed autoscroll initiation. When a subsequent switch actuation occurs in FIG. 6, it is the control transfer through step 222 that allows for manual scrolling of messages to the display.

In FIG. 6, it can be seen that the scrolling of all pages in both multiple page messages and multiple messages may be accomplished either automatically by the timed autoscroll method or manually by the actuation of switch 70. If a subsequent switch actuation occurs at any point during the message scrolling sequence, control is transferred to step 100 where the message transfer and illumination features are reinitiated. If no subsequent switch actuation occurs after an initial actuation of switch 70, all pages of a multiple page message and all messages in memory will be scrolled on a time sequence basis to the display 50.

A subsequent switch actuation during the autoscroll feature will accomplish one of the following: (1) the next page of a multiple page message will be transferred to the display (step 234); (2) the next message stored in memory will be transferred to the display (steps 232 or 236); or (3) the scrolling process will cease due to the transfer of the last page of the last message held in memory (steps 228 (no branch) or 235 (yes branch)). Thus, multiple messages and multiple page messages may be displayed by multiple switch actuations of switch 70 or by a single switch actuation utilized in conjunction with the timed autoscroll feature.

Referring to FIG. 7, a canned message feature is added to the steps described in FIG. 6. As described above, control is transferred to steps 100 upon every switch actuation. The illumination feature embodiments are initiated as described above (see FIG. 2 or 4). After step 100 and then step 102, control is transferred to step 320 where the pager control program determines whether there is a message being displayed. If there is no message being displayed, control is transferred from step 320 to step 324. In step 324, the control program determines whether there are messages in memory. If there are no messages in memory, control is transferred from step 324 to step 325 where a canned message is displayed. Typically, a canned message may indicate that there are no messages received or no messages being stored in memory. Such a canned message may indicate a code message recognized by the pager user to indicate the particular status such as "ZERO CALL" or "NO CALL."

After the canned message is sent to the display 50 in step 325, control is transferred to step 338 for the released switch determination described above as step 128. Subsequent to step 338, control is transferred to step 340 where the elapsed time autoscroll feature is initiated. In step 340, an eight second timer is started. Control is transferred from 340 to 342 where the eight second time period is determined to be elapsed. After the eight second time period is elapsed, control is transferred from step 342 to step 344. In step 344, the control program determines if the message being displayed is the last page of the current message being displayed or a canned message.

If the message being displayed is neither the last page of the current message nor a canned message, control is transferred from step 344 to step 346 where the next page of the current message being displayed is transferred to the display. After the next page of the current message is transferred to the display in step 346, control is transferred back to step 340 where the eight second timer is reinitiated. These steps will continue until the last page of the multiple page message is displayed or a switch actuation occurs.

If a canned message or the last page of the multiple page message is displayed in step 344, control is transferred to step 328. In step 328, the control program determines if the message being displayed is the last message held in memory or a canned message display. If the message being displayed is the last message held in memory or a canned message, control is transferred from step 328 to step 160 (FIG. 4) for the clear message display.

If it is determined that the message being displayed is neither the last message held in memory nor a canned message in step 328, control is transferred to step 332 where the first page of the next message held in memory is displayed. After the first page of the next message is transferred to the display, control is transferred to step 338 for the switch release determination and then to step 340 for initiation of the timed autoscroll feature as described above.

Upon transfer of control to step 320, the control program determines if there is a current message being displayed. If there is no message being displayed, control is transferred to step 324. In step 324, the control program determines whether there are messages stored in memory. If there are messages in memory, step 324 transfers control to step 326 where the first page of the first message held in memory is transferred to the display 50. After the first page of this message has been transferred to the display, control is transferred to step 338 for the switch release determination and then to step 340 for the initiation of the timed autoscroll feature.

After control is transferred to step 320, the control program determines if there is a message being displayed on the display. If there is a message being displayed, control is transferred from step 320 to step 322 where the control program determines if the current message being displayed is a multiple page message. If the current message being displayed is not multiple page message, control is transferred from step 322 to step 328. The operation of step 328 and subsequent steps is described above.

If the message being displayed is a multiple page message, control is transferred from step 322 to step 330. In step 330, the control program determines if the current multiple page message being displayed is the last page of this message. If the current page of the message being displayed is not the last page of this message, control is transferred from 330 to 334 where the next page of the current multiple page message is transferred to the display. If the current page of the message being displayed is the last page of this message, control is transferred from step 330 to step 335 where the control program determines if this is the last message held in memory. If so, control is transferred to step 160 for the clear message display.

If the message being displayed is not the last message held in memory in step 335, control is transferred to step 336 where the first page of the next message held in memory is transferred to the display. After the operation of either step 334 or step 336, control is transferred to step 338 for the switch release determination and then to step 340 for the initiation of the timed autoscroll sequence. As disclosed earlier, any subsequent switch actuation during the message scrolling process will transfer control to steps 100 and 102 for reinitiation of the message display sequence utilizing the next page of the multiple page message being displayed, the next message stored in memory (if the last page of the current message is being displayed), or termination of the message display sequence (if the last page of the last message in memory or a canned message is already being displayed). In this manner, the operation of FIG. 7 is almost identical to the operation of FIG. 6 except for addition of the canned message feature and the modifications to the operation necessary to support this additional feature.

Figure 8:
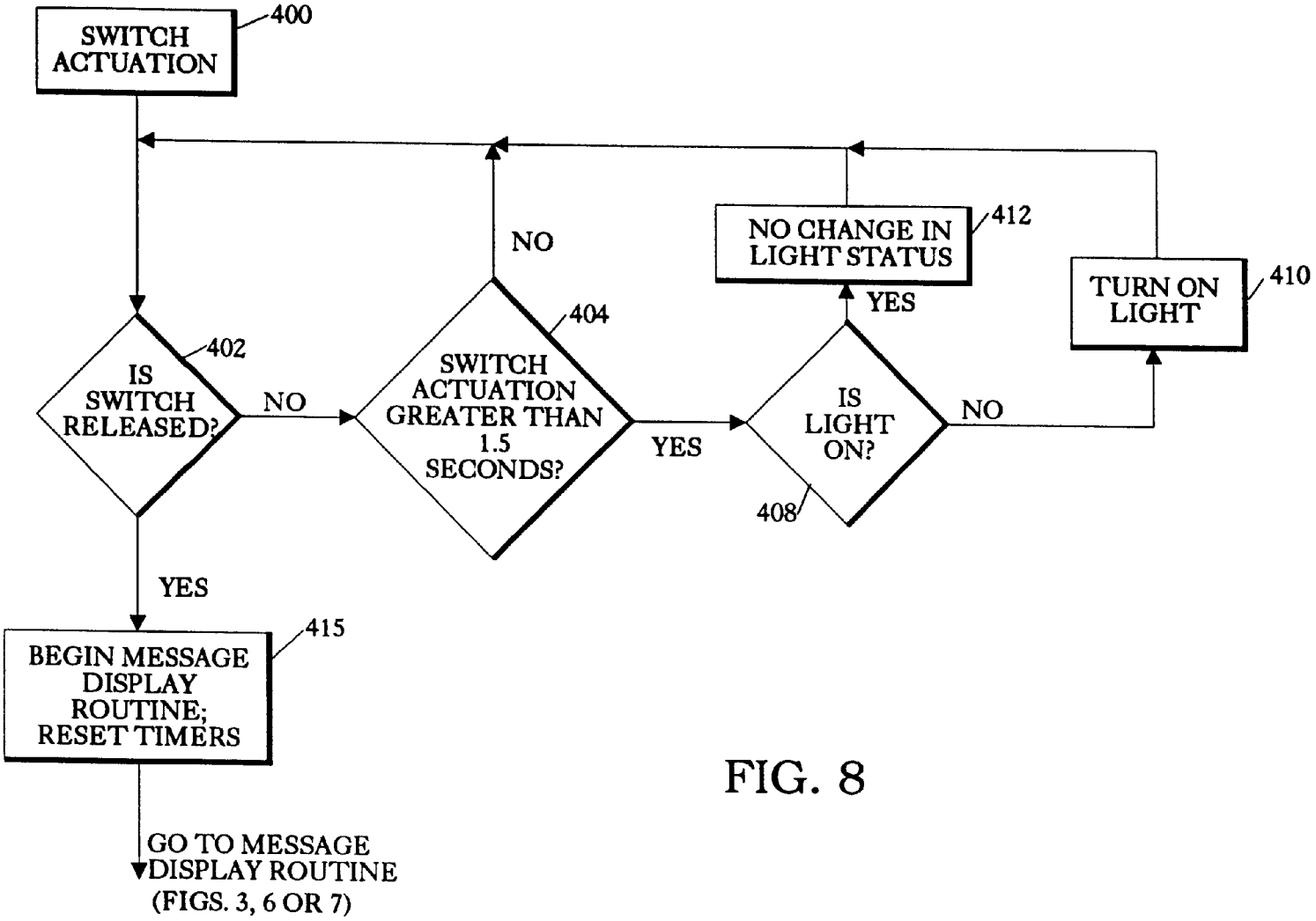
Figure 9:
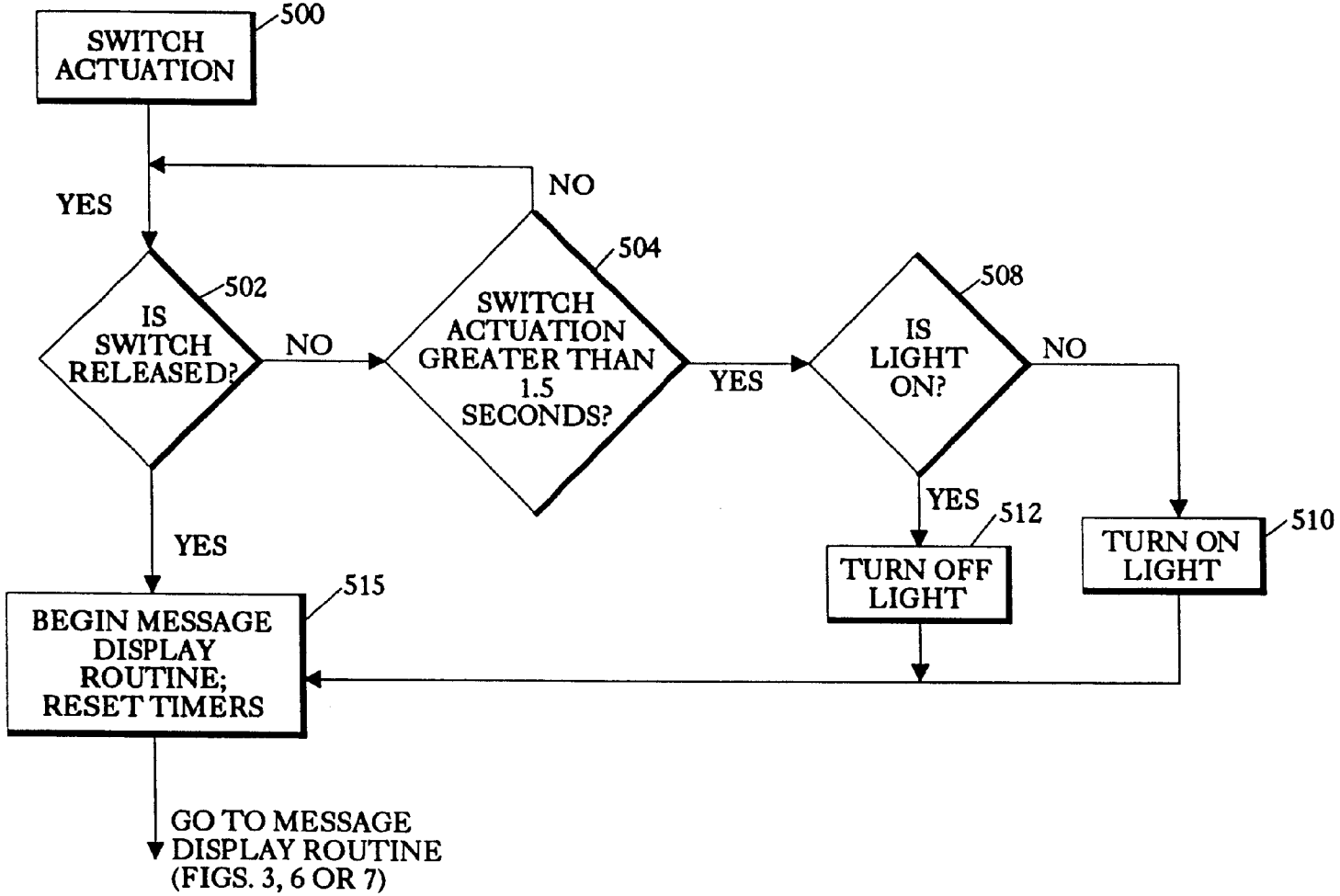

Alternative embodiments for the activation of the light 60 for the display 50 are shown in FIGS. 8 and 9. In FIG. 8, a switch 70 actuation is detected in step 400. After step 400, control is transferred to step 402 where the current condition of the switch 70 is determined. If the switch is released as determined by step 402, control is transferred to step 415 where the message display operation is initiated. Message display operation beginning at step 415 is identical to any of the above described message display embodiments described from FIG. 3, 6 or 7.

If the switch 70 is still actuated in step 402, control is transferred to step 404 where the time duration of the switch 70 activation is determined. If switch 70 has been actuated for less than 1.5 seconds, control is transferred from step 404 back to step 402 where the current condition of the switch 70 is determined. If the switch 70 activation is greater than 1.5 seconds, control is transferred from step 404 to step 408 where the current condition of the light 60 for the display 50 is determined. If the light 60 has already been activated, step 408 transfers control to step 412 where no change in the light source condition is made. After step 412, control is transferred to step 402 where the condition of the message transfer switch 70 is determined.

In step 408, control is transferred to step 410 if the light 60 is not activated. In step 410, the light 60 is activated thereby illuminating the display 50. After step 410, control is transferred back to step 402 where the current condition of the message switch 70 is determined.

After the switch 70 is released, step 402 transfers control to step 415 where the message display routine is initiated and the timers are reset. The message display routine after step 415 is identical to those message display routines previously described in the above embodiments. (See FIG. 3, 6 or 7.) By structuring the command sequence in this manner, the pager 5 detects switch 70 actuations which continue for a time period greater than 1.5 seconds and alter the light conditions in response to such switch 70 actuation. Additionally, the message display routine will only be initiated after switch 70 is released.

In FIG. 9, the switch 70 actuation is detected in step 500. After step 500, control is transferred to step 502 where the condition of the message transfer switch 70 is determined. If the switch 70 is no longer actuated, control is transferred from step 502 to step 515 where one of the message display operations previously described is initiated thereafter. (See FIG. 3, 6 or 7.)

If the switch 70 is still actuated in step 502, control is transferred to step 504. In step 504, the pager determines whether the switch 70 actuation is greater than 1.5 seconds. If the switch 70 actuation time is not greater than 1.5 seconds, control is transferred from step 504 to step 502 where the condition of the switch 70 is determined. If the switch 70 actuation is greater than 1.5 seconds, step 504 transfers control to step 508 where the current condition of the light 60 is determined. If the light 60 is activated, control is transferred from step 508 to step 512 where the light 60 is deactivated or turned "off." If the light 60 is not already activated in step 508, control is transferred to step 510 where the light 60 is activated or turned "on."

After steps 512 or 510, control is transferred to step 515 where the message display operation is initiated immediately thereafter. This message display operation is identical to the message display operations of the embodiments described above. (See FIG. 3, 6 or 7.) In this manner, the display operation begins after a predetermined time period elapses with the switch 70 being continuously actuated. There is no need to de-actuate, (or release) the switch in order to begin the message display operation in this embodiment. Thus, no switch de-actuation is necessary to begin the message transfer sequence as with the embodiment disclosed in FIG. 8.

Again, the 1.5 second interval utilized in steps 404 and 504 on FIGS. 8 and 9 can be adjusted to accommodate an individual pager user's needs. This adjustment may be manually set on certain switches 45 provided on the pager 5 or set by selecting alternatives in a pager user selection program.

Figure 10:
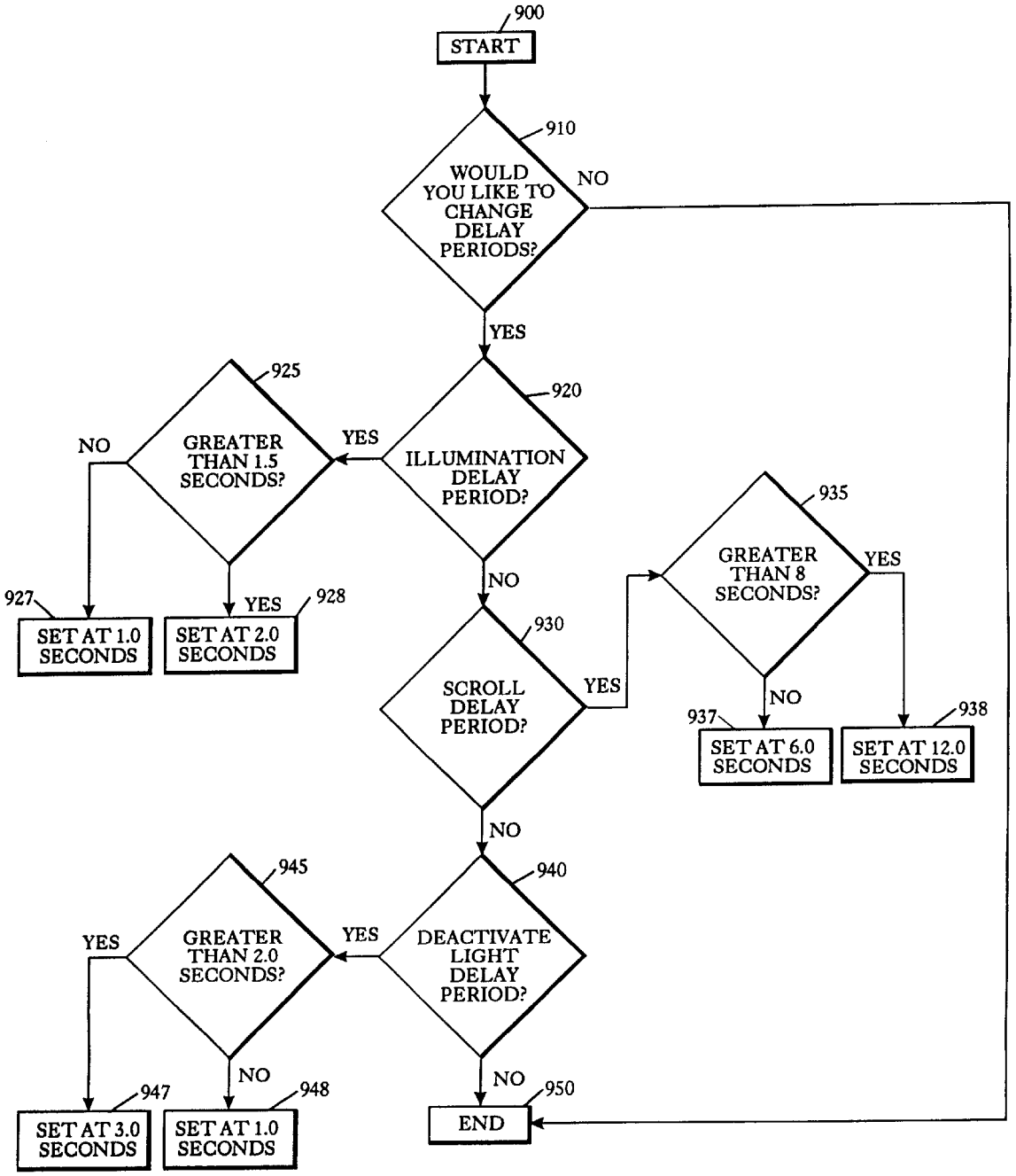
FIG. 10 is a flow chart which illustrates a pager user interaction program utilized in setting the delay period in a pager.

In FIG. 10, a pager user interaction program flow chart is shown. This interaction program allows the pager user to set specified delay periods needed in the message sequencing and illumination programs. Beginning at step 900, control is transferred to step 910 where an inquiry is made as to whether the pager user would like to change delay periods. At step 910, if the pager user selects the NO answer, control is transferred to step 950 where the interaction program ends. If the pager user selects the YES answer from step 910, control is transferred to step 920.

In step 920, the pager user interaction program inquires whether the pager user would like to change the delay period for the illumination delay. This delay period is the time period of continuous actuation of switch 70 necessary to activate the illumination of light 60. If the pager user selects the YES answer from step 920, control is transferred to step 925 where the pager user interaction program makes the inquiry whether the pager user wants a delay period greater than 1.5 seconds. If the pager user selects the NO answer, control is transferred from step 925 to step 927 where the delay period is set at 1.0 seconds. If the pager user selects the YES answer in step 925, control is transferred to step 928 where the delay period is set at 2.0 seconds.

If the pager user selects the NO answer in step 920, control is transferred to step 930 where the pager user interaction program inquires if the pager user would like to change the delay period for the scrolling of messages and pages of messages. This delay period is usually eight seconds and occurs in the automatic scrolling of messages, or pages of messages, from the memory to the display 50. If the pager user selects the YES answer in step 930, control is transferred to step 935, where the pager user interaction program inquires if the pager user wants a delay period of greater than 8.0 seconds. If the pager user selects the YES answer in step 935, control is transferred to step 938 where the delay period is set at 12.0 seconds. If the pager user selects the NO answer in step 935, control is transferred to step 937 where the delay period is set at 6.0 seconds.

In step 930, if the pager user selects the NO answer, control is transferred to step 940 where the pager user interaction program inquires if the pager user would like to change the delay period for the light deactivation. If the pager user selects the NO answer in step 940, control is transferred to step 950 where the pager user interaction program ends. If the pager user selects the YES answer in step 940, control is transferred to step 945 where the pager user interaction program inquires if the pager user wants a delay period for light deactivation of greater than 2.0 seconds. This light deactivation period is the delay period following the transfer of the last message (sometimes the last page of the last message or the canned message) to the display before light 60 is deactivated. Usually this delay period is set at 2.0 seconds. If the pager user selects the NO answer in step 945, control is transferred to step 948 where this delay period is set at 1.0 seconds. If the pager user selects the YES answer in step 945, control is transferred to step 947 where this delay period is set at 3.0 seconds.

It is understood that this pager user interaction program may be modified slightly to accommodate for different time period selections and different delay periods utilized within the present invention.

In summary, the present invention provides a display pager which activates a light 60 in response to the actuation of switch 70 for a predetermined time period. The present invention also provides for automatic and manual scrolling of multiple page messages and multiple messages stored in memory. The above features are accomplished through the coordination of switch 70 actuation and time sequence automated control. The illumination of the display and the scrolling of messages is accomplished with less components than previously needed in modern pagers thereby reducing cost, size, and circuit complexity. Additionally, the message sequencing process provides greater flexibility in message display operations of pagers.

This invention has been described with various references to the illustrated embodiments. It is not intended that this description be construed as limiting the scope of the claimed invention. It is contemplated that the appended claims will cover any modifications and embodiments as fall within the true scope of the invention.

What is claimed is:

1. A method for displaying messages which have been stored in the memory of a pager, wherein each message has one or more pages, the method comprising the steps of:

receiving a user input signal from a multiple function switch, said switch being capable of initiating both a manual message display mode or a free-running display mode based upon the receipt or absence of a further of said user input signals from said multiple function switch, said manual display mode being initiated by a further receipt of said further user input signal and said free-running display mode being automatically initiated without further receipt of said user input signal, said free-running display mode comprising the following steps:

transferring a first page of a first of said messages from said memory to a display of said pager, displaying said first page of said first message transferred to said display for a predetermined period of time, sequentially transferring each of the remaining pages of said first message to said display wherein each of said pages of said first message is displayed for said predetermined period of time, transferring a first page of a second of said messages from said memory to said display at the completion of the display of all pages of said first message, displaying said first page of said second message transferred to said display for said predetermined period of time, and sequentially transferring each of the remaining pages of said second message to said display wherein each of said pages of said second message is displayed for said predetermined period of time wherein the manual display mode may be initiated during the free-running display mode by a subsequent user input signal from said multiple function switch.

2. A method for displaying messages which have been stored in the memory of a pager as recited in claim 1 including the steps of sequentially transferring each of the pages of each of the remaining ones of said messages from said memory to said display wherein each of said pages is displayed for said predetermined period of time.

3. The method for displaying messages which have been stored in the memory of a pager as recited in claim 1 wherein said predetermined period of time is adjustable.

4. A method for displaying messages which have been stored in the memory of a pager as recited in claim 1 including the step of activating a light for illuminating said display in response to a continuous actuation of said switch for a second predetermined period of time.

5. The method for displaying messages which have been stored in the memory of a pager as recited in claim 4 wherein said second predetermined period of time may be adjusted.

6. A method for displaying messages which have been stored in the memory of a pager, comprising the steps of:

receiving a user input signal from a multiple function switch, said switch being capable of initiating both a manual message display mode or a free-running display mode based upon the receipt or absence of a further of said user input signals from said multiple function switch, said manual display mode being determined by a further receipt of said user input signal and said free-running display mode being automatically initiated without further receipt of said user input signal, said free-running display mode comprising the following steps:

transferring a first of said messages from said memory to a display of said pager, displaying said first message transferred to said display for a predetermined period of time, transferring a second of said messages from said memory to said display at the end of said predetermined period of time, and displaying said second message transferred to said display for said predetermined period of time wherein said manual display mode may be initiated during said free running display mode by a subsequent user input signal received from said multiple function switch.

7. A method for displaying messages which have been stored in the memory of a pager as recited in claim 6 including the steps of sequentially transferring each of the remaining ones of said messages from said memory to said display wherein each of said messages is displayed for said predetermined period of time.

8. A method for displaying messages which have been stored in the memory of a pager as recited in claim 6 including a step of activating a light for illuminating said display in response to a continuous actuation of said switch for a second predetermined period of time.

9. A method for displaying messages which have been stored in the memory of a pager as recited in claim 8 including a step of deactivating said light in response to a continuous actuation of said switch for third predetermined period of time.

10. A method for displaying messages which have been stored in the memory of a pager as recited in claim 9 wherein said second and third periods of time are identical lengths of time.

11. A method of displaying messages which have been stored in the memory of the pager, wherein each message has one or more pages, the method comprising the steps of:

receiving a first short-duration user input signal from a multiple function switch to place said pager in an initial free-running display mode to carry out an initial sequence of steps without further receipt of said user input signal, said initial sequence of steps comprising:

(a) transferring a first page of a first of said messages from said memory to a display of said pager, (b) displaying said first page of said first message transferred to said display for a predetermined period of time, (c) sequentially transferring each of the remaining pages of said first message to said display wherein each of said pages of said first message is displayed for said predetermined period of time, receiving a second discrete short-duration user input signal from said multiple function switch to place said pager in a subsequent free-running display mode to carry out a subsequent sequence of steps without further receipt of said user input signal, said subsequent sequence of steps comprising:

(a) transferring a first page of a second of said messages from said memory to said display of said pager in response to a subsequent switch actuation of said switch mounted on said pager, (b) displaying said first page of said second of said messages transferred to said display for said predetermined period of time, (c) sequentially transferring each of the remaining pages of said second message to said display wherein each of said pages is displayed for said predetermined period of time.

12. The method for displaying messages which have been stored in the memory of a pager as recited in claim 11 wherein said predetermined period of time may be adjusted.

13. The method for displaying messages which have been stored in the memory of a pager as recited in claim 11 further comprising the step of:

displaying the last one of said pages of said messages transferred to said pager display for longer than said predetermined period of time in response to the continuous actuation of said switch.

14. A method for displaying messages which have been stored in the memory of a pager, comprising the steps of:

receiving a first short-duration user input signal from a multiple function switch to place said pager in a free-running display mode to carry out a sequence of steps without further receipt of said user input signal, said sequence of steps comprising:

(a) transferring a first message from said memory to said display, (b) displaying said first message for a predetermined period of time, (c) sequentially transferring other of said messages from said memory to said display of said pager, (d) displaying each of said other messages transferred to said pager display for said predetermined period of time, terminating the display of a currently displayed one of said messages in response to a subsequent receipt of a second discrete short-duration user input signal from said multiple function switch.

15. A method for displaying messages which have been stored in the memory of a pager as recited in claim 14 including a step of activating a light for illuminating said display in response to a continuous actuation of said switch for a second predetermined period of time.

16. A method for displaying messages which have been stored in the memory of a pager as recited in claim 15 including a step of deactivating said light in response to a continuous actuation of said switch for third predetermined period of time.

17. A method for displaying messages which have been stored in the memory of a pager as recited in claim 16 wherein said second and third periods of time are identical lengths of time.

18. The method of displaying messages which have been stored in the memory of a pager as recited in claim 14 wherein said predetermined period of time may be adjusted.

19. The method for displaying messages which have been stored in the memory of a pager as recited in claim 14 further comprising the step of:

displaying the last one of said messages transferred to said pager display for longer than said predetermined period of time in response to the continuous actuation of said switch.

20. A method for displaying messages which have been stored in the memory of a pager, wherein each message has one or more pages, the method comprising the steps of:

receiving a first short-duration user input signal from a multiple function switch to place said pager in a free-running display mode to carry out a sequence of steps without further receipt of said user input signal, said sequence of steps comprising:

(a) transferring a first page of a first message from said memory to a display of said pager, (b) displaying said first page of said first message, (c) sequentially transferring other of said pages of said first message from said memory to said display, (d) displaying each of the pages of each of said messages transferred to said pager display for a predetermined period of time wherein a deactuation of said switch occurs prior to the sequential display of all remaining pages of said first message in memory, terminating the display of a currently displayed one of said pages in response to a subsequent receipt of a second discrete short-duration user input signal from said multiple function switch, and transferring a next of said pages from said memory to said display after said termination of the display of said currently displayed message.

21. A method for displaying messages which have been stored in the memory of a pager as recited in claim 20 including a step of activating a light for illuminating said display in response to a continuous actuation of said switch for a second predetermined period of time.

22. A method for displaying messages which have been stored in the memory of a pager as recited in claim 21 including a step of deactivating said light in response to a continuous actuation of said switch for third predetermined period of time.

23. A method for displaying messages which have been stored in the memory of a pager as recited in claim 22 wherein said second and third periods of time are identical lengths of time.

24. The method of displaying messages which have been stored in the memory of a pager as recited in claim 20 wherein said predetermined period of time may be adjusted.

25. The method for displaying messages which have been stored in the memory of a pager as recited in claim 20 further comprising the step of:

displaying the last one of said pages of said messages transferred to said pager display for longer than said predetermined period of time in response to the continuous actuation of said switch.

26. A method for displaying messages which have been stored in the memory of a pager, wherein each message has one or more pages, the method comprising the steps of:

sequentially transferring each page of said messages from said memory to a display of said pager in response to a single short-duration actuation of a multiple function switch mounted on said pager, displaying each page of said messages transferred from memory on said pager display, and holding a displayed one of the pages of said messages on said display in response to a second discrete actuation of said multiple function switch, said display of said page of the message being held on the display as long as the actuation of said switch is continuous is maintained in an actuated state.

27. The method of displaying messages which have been stored in the memory of a pager as recited in claim 26 further comprising the step of:

terminating the display of one of said pages of said messages in response to a subsequent actuation of said switch mounted on said pager.

* * * * *